US010648753B1

(12) United States Patent
Jarratt

(10) Patent No.: US 10,648,753 B1
(45) Date of Patent: May 12, 2020

(54) AMMUNITION MAGAZINE DEVICE

(71) Applicant: Hugh Mills Jarratt, Fayetteville, AR (US)

(72) Inventor: Hugh Mills Jarratt, Fayetteville, AR (US)

( * ) Notice: Subject to any disclaimer, the term of this patent is extended or adjusted under 35 U.S.C. 154(b) by 0 days.

(21) Appl. No.: 16/173,730

(22) Filed: Oct. 29, 2018

Related U.S. Application Data

(63) Continuation-in-part of application No. 15/607,470, filed on May 27, 2017, now Pat. No. 10,113,820.

(60) Provisional application No. 62/342,662, filed on May 27, 2016.

(51) Int. Cl.
*F41A 9/66* (2006.01)
*F41A 9/70* (2006.01)

(52) U.S. Cl.
CPC . *F41A 9/66* (2013.01); *F41A 9/70* (2013.01)

(58) Field of Classification Search
CPC ..... F41A 9/65; F41A 9/66; F41A 9/70
USPC ..... 42/49.01, 49.02, 50
See application file for complete search history.

(56) References Cited

U.S. PATENT DOCUMENTS 2,620,061 A * 12/1952 Uxa ..... A24F 15/16 221/229
3,443,334 A * 5/1969 Ardolino ..... F41A 9/70 42/50
3,453,762 A * 7/1969 Freemont ..... F41A 9/67 206/3
3,777,383 A * 12/1973 Haines ..... F41A 9/72 42/49.02
4,430,821 A * 2/1984 Vincent ..... F41A 9/67 42/50
4,831,761 A * 5/1989 Kulakow ..... F41A 9/67 42/50
5,081,778 A * 1/1992 Switzer ..... F41A 9/66 42/50
5,388,360 A * 2/1995 Fortunato ..... F41A 9/70 42/50
10,113,820 B1 * 10/2018 Jarratt ..... F41A 9/66
2016/0370138 A1 * 12/2016 Zamm ..... F41A 9/66

* cited by examiner

*Primary Examiner* — Bret Hayes
(74) *Attorney, Agent, or Firm* — Schrantz Law Firm, PLLC; Stephen D. Schrantz

(57) ABSTRACT

A firearm magazine assists loading of a housing with ammunition. The ammunition inserts into an opening in the top of the housing against a follower. The follower creates tension on the ammunition to direct the ammunition towards the opening. An adjustable plate contacts the spring to load the spring against the follower. The adjustable plate adjusts between a use position and a load position. The use position provides appropriate force to load the ammunition into the chamber. The plate adjusts away from the follower to decrease the tension of the spring and the follower to load the magazine.

17 Claims, 10 Drawing Sheets

AMMUNITION MAGAZINE DEVICE

CROSS-REFERENCE TO RELATED APPLICATIONS

This application claims priority to and is a continuation in part of U.S. patent application Ser. No. 15/607,470 filed on May 27, 207 entitled "AMMUNITION MAGAZINE DEVICE" which is a continuation in part of U.S. Patent Application No. 62/342,662 filed on May 27, 2016 entitled "AMMUNITION MAGAZINE DEVICE" which are hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

I. Field of the Invention

The present invention is related to an improved firearm magazine. The present invention provides a housing for insertion of the firearm shells. The shells insert into an opening in the top of the housing. A spring creates tension on the shells to direct the shells toward the opening in the top towards the firearm.

II. Background of the Invention

Firearm clips require manual loading of the shells within the opening in the top of the clip. Each shell inserts into the clip on top of the previously loaded shell. The resistance of the spring increases as more shells are loaded into the clip. The increased resistance increases the difficulty of loading the shells into the clip.

Many people do not have the strength or dexterity to manually load the clip or to fully load the clip. The resistance of the spring increases the difficulty of loading the clip such that a user's hands and fingers tire while loading the clip. The spring also slows down the process of loading the clip.

Many attempts have been made to provide clips or devices that are used with clips to facilitate the loading of the shells into the clips. The modified clips increase the likelihood that the shells will fall into the clip in a vertical or diagonal orientation. The user must empty the clip to remove the misaligned shells. The user must then reload the shells into the clip.

Patents and patent applications disclosing information relevant to the present invention are disclosed below. These patents and patent applications are hereby expressly incorporated by reference in their entirety.

U.S. Pat. No. 7,200,964 issued to Gates on Apr. 10, 2007 ("the '964 patent") teaches a clip that has an elongated housing extending from an open top end to an enclosed bottom end defining an elongated cartridge storage chamber. The clip taught by the '964 patent has a cartridge support seat mounted in the chamber above a separate elevator element. A chamber compression spring taught by the '964 patent is mounted in the chamber between a base at the bottom end and the elevator element to urge the elevator element upward. A separate movement-restraining means taught by the '964 patent is associated with the cartridge support seat to resist downward movement of the seat from the opening at the top end. The clip taught by the '964 patent has a loading facilitating means for selectively rendering the compression spring ineffective to urge the seat upward to thereby reduce the manual effort required to load the clip.

SUMMARY OF THE INVENTION

The present invention is related to an improved firearm magazine. The present invention provides a housing for insertion of the firearm shells. The shells insert into an opening in the top of the housing against a follower. The follower creates tension on the shells to direct the shells toward the opening in the top towards the firearm. A spring attaches to an adjustable plate and the follower to direct the shells towards the opening in the top of the housing.

The spring creates tension on the shells as the shells are loaded. The adjustable plate adjusts between a use position and a load position. The use position provides appropriate force to load the shells into the chamber. When loading the magazine, the user adjusts the plate to a load position. The plate drops vertically downward to decrease the tension of the spring and the follower. The reduced tension decreases the amount of force required to load the magazine. The user can then load the cartridges into the magazine using less energy and force.

The user then places the adjustable plate into the use position after loading the magazine. The user inserts the magazine into the firearm to load the firearm.

It is an object of the present invention to simplify the loading of the firearm magazine.

It is another object of the present invention to reduce the time required to load a magazine.

It is another object of the present invention to reduce the amount of force required to load a magazine.

It is another object of the present invention to provide an adjustable plate the changes the amount of tension applied to the cartridges.

It is another object of the present invention to decrease tension while loading the magazine.

It is another object of the present invention to increase tension when the magazine is in use.

It is another object of the present invention to enable a user to load the magazine and then adjust the adjustable plate to the use position.

These and other objects and advantages of the present invention, along with features of novelty appurtenant thereto, will appear or become apparent by reviewing the following detailed description of the invention.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
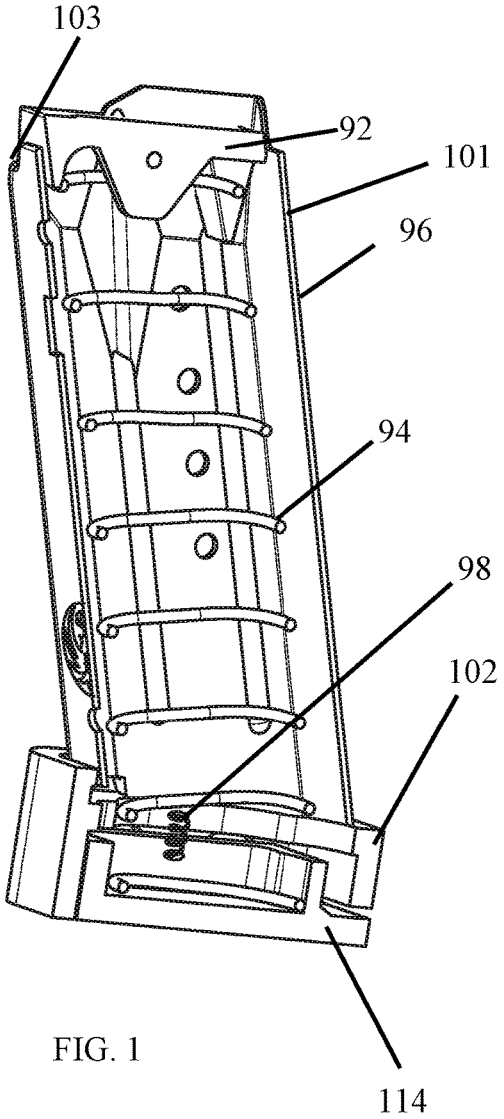
FIG. 1 is a sectional view of one embodiment of the present invention.
Figure 2:
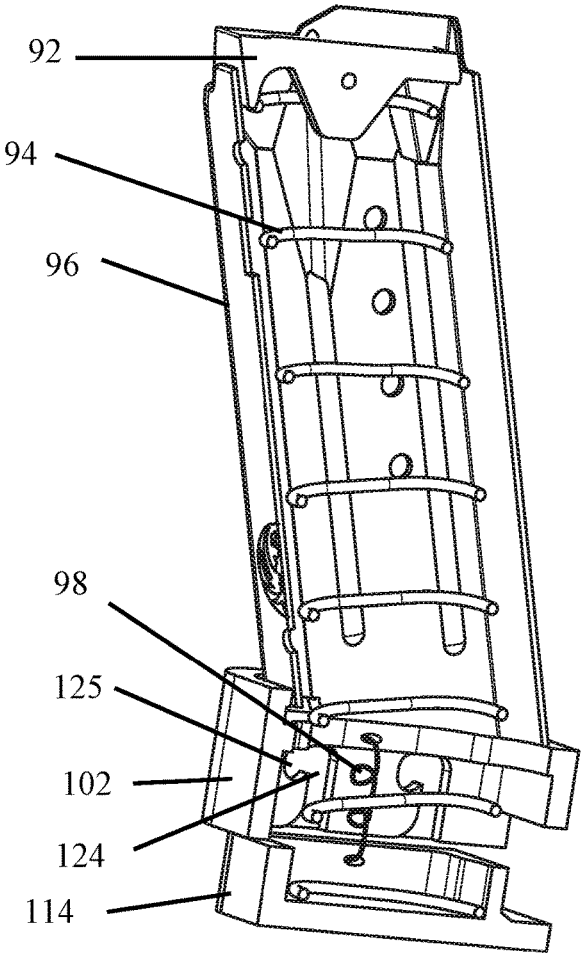
FIG. 2 is a sectional view thereof.

FIGS. 1-2 show the firearm magazine 96 of the present invention for a pistol. A user loads ammunition, such as cartridges, into the magazine 96. The magazine 96 directs the cartridges to the chamber of the firearm. A spring 94 located within the housing 101 directs the follower 92 towards the chamber and the opening 103. The spring 94 exerts a force on the follower 92 directing the follower 92 towards opening 103.

Known magazines require the user to manually overcome the force of the spring 94 when inserting cartridges into the magazine. The magazine 96 of the present invention enables the user to reduce the force of the spring 94 on the follower 92.

The opening 103 in the top of the housing 101 enables loading of the cartridges vertically into the chamber of the firearm. The follower 92 directs the cartridges towards the opening 103 and the chamber. Spring 94 directs the cartridges and follower 92 towards the opening 103.

As shown in FIGS. 1-4, the base 102 attaches to the magazine 96 and housing 101. At least a lower portion of the magazine fits within the horizontal installation aperture 112 below the attachment lip 110 of the attachment base 102. Vertical installation apertures 106, 108 accept vertical insertion of the base 102 onto the magazine for securing the base 102 to the magazine 96.

Attachment of the base 102 to the magazine 96 enables attachment of the adjustable plate 114 to the magazine 96 as well. The adjustable plate 114 adjusts between a use position shown in FIG. 1 and a load position shown in FIG. 2. Tether 98 secures the plate 114 to the base 102. The tether 98 limits movement of the plate 114 in relation to the base 102. The tether 98 limits loss of the plate 114 and limits the movement of the spring 94. The tether 98 allows sufficient movement of the plate 114 needed to adjust between the use position and the load position. In one embodiment, the tether allows a half inch to three inches of downward movement, preferably one inch.

In the use position shown in FIG. 1, the plate 114 loads the spring 94 against the follower 92. The spring 94 is tensioned for use with the plate 114 secured within the base 102. The magazine can be loaded into the firearm for use.

FIG. 2 shows the plate 114 adjusted to the load position. The plate 114 is adjusted away from the follower 92. Plate 114 is lowered vertically from base 102. Adjusting the plate 114 away from the follower 92 reduces the tension of the spring on the follower 92. The reduced tension on the follower 92 reduces the force needed to load the magazine.

Tether 98 limits the movement of the plate 114 to reduce the chance that the user loses the plate 114. In one embodiment, the spring defines a vertical axis in which the spring supplies a vertical upward force against the follower. Adjusting the plate 114 vertically downward and/or otherwise away from the follower 92 relieves the tension on the follower 92.

Figure 8:
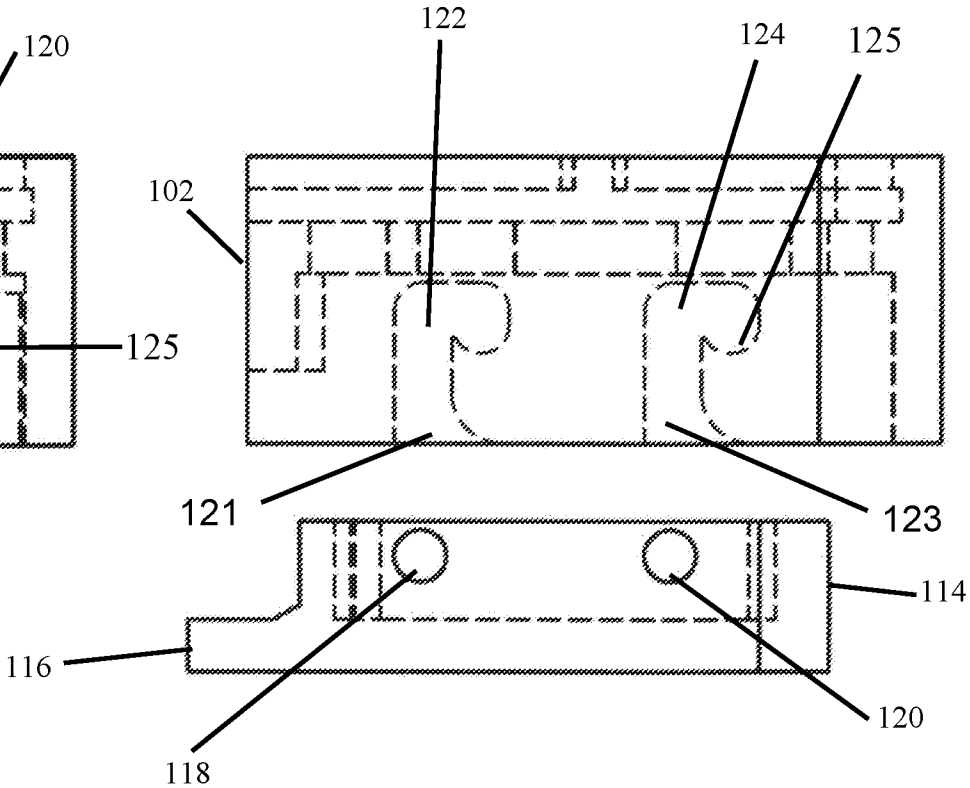
FIG. 8 is a sectional view thereof.
Figure 7:
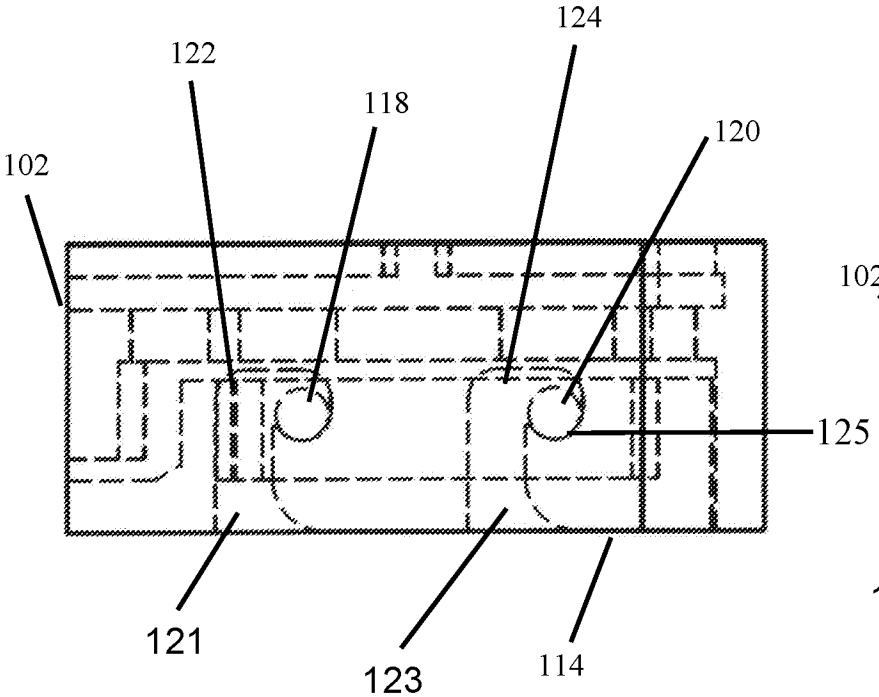
FIG. 7 is a sectional view thereof.

The plate 114 secures to the base 102 via an adjustment track 124 as shown in FIGS. 2 and 7-8 and will be described in relation to FIGS. 7 and 8. The plate 114 provides an extension that fits within adjustment track 124. Locking position 125 at the end of the adjustment track 124 limits the vertical downward movement of the plate 114 within the base 102. Placement of the plate 114 within the locking position 125 secures the plate 114 within the use position.

Figure 4:
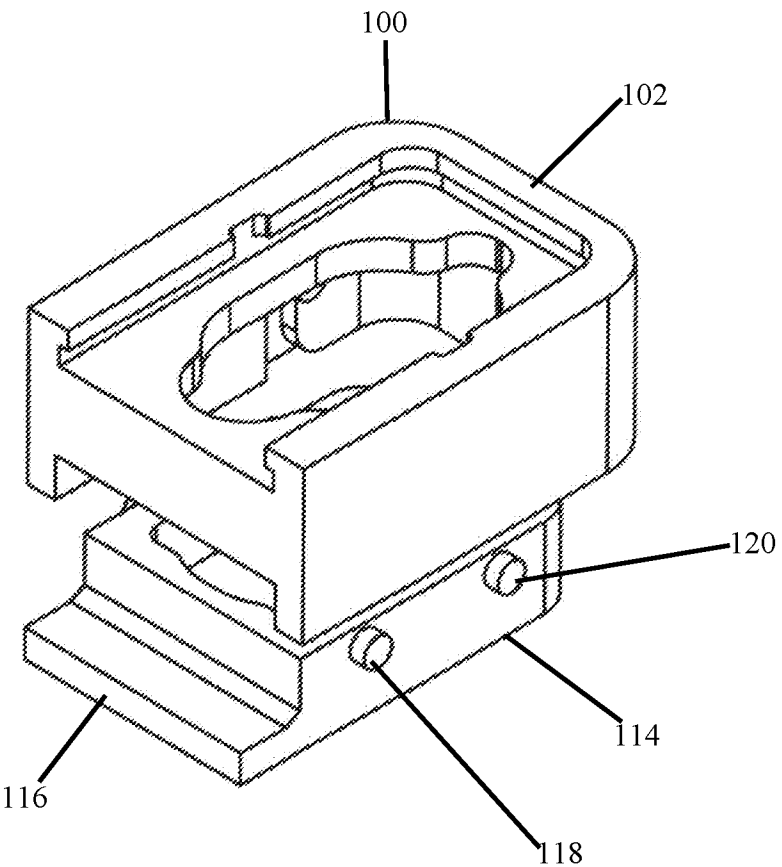
FIG. 4 is a perspective view thereof.
Figure 3:
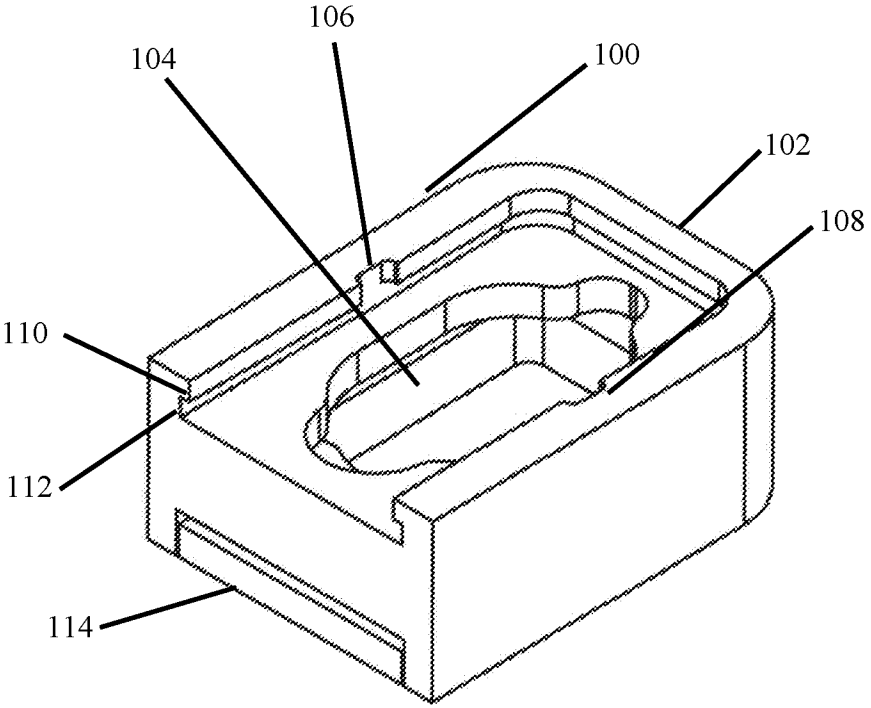
FIG. 3 is a perspective view thereof.

The plate 114 attaches to the base 102 in the use position as shown in FIG. 3 and releases from within the base as shown in FIG. 4 to the load position. Installation apertures 106, 108, 112 secure the attachment base 102 to the magazine. Attachment lip 110 secures the base 102 to the magazine as discussed above.

Referring to FIGS. 1-3, the attachment base 102 provides a tensioning aperture 104 that enables the spring 94 to pass through the base 102 to contact the floor of the plate 114. The spring 102 contacts the plate 114 after passing through the tensioning aperture 104. The tensioning aperture 104 of one embodiment is sized to allow the spring to pass through the tensioning aperture 104 while preventing the follower from passing through the tensioning aperture 104.

FIG. 4 shows the plate 114 adjusted to the load position. Attachment fingers 118, 120 fit within the adjustment tracks. The attachment fingers 118, 120 extend outward from the plate 114 to fit within the adjustment tracks.

Blocking foot 116 extends outward from the plate 114. The blocking foot 116 prevents the plate 114 from entering too far into the base 102.

Figure 5:
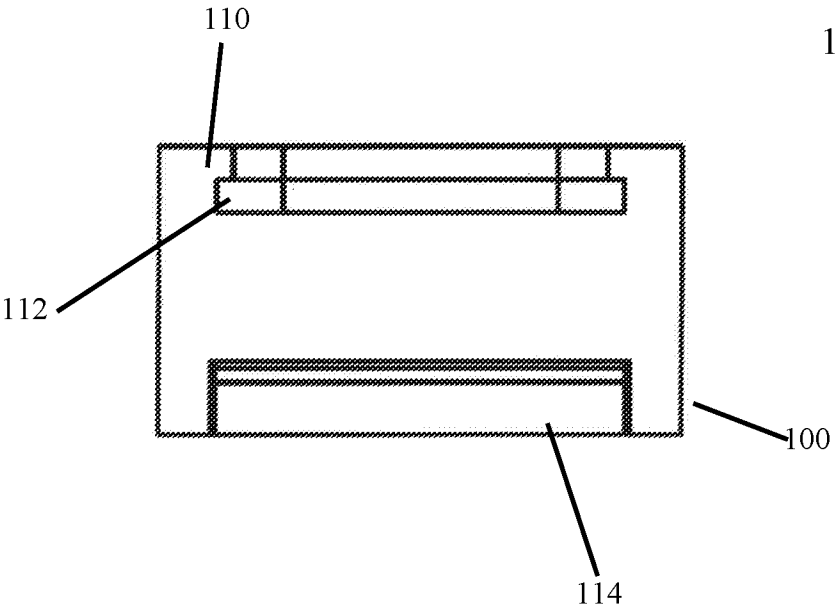
FIG. 5 is a front view thereof.

FIG. 5 shows the attachment lip 110 and the attachment aperture 112 for placement of the magazine. Placement of the magazine within attachment aperture 112 secures the base 102 to the magazine.

Figure 6:
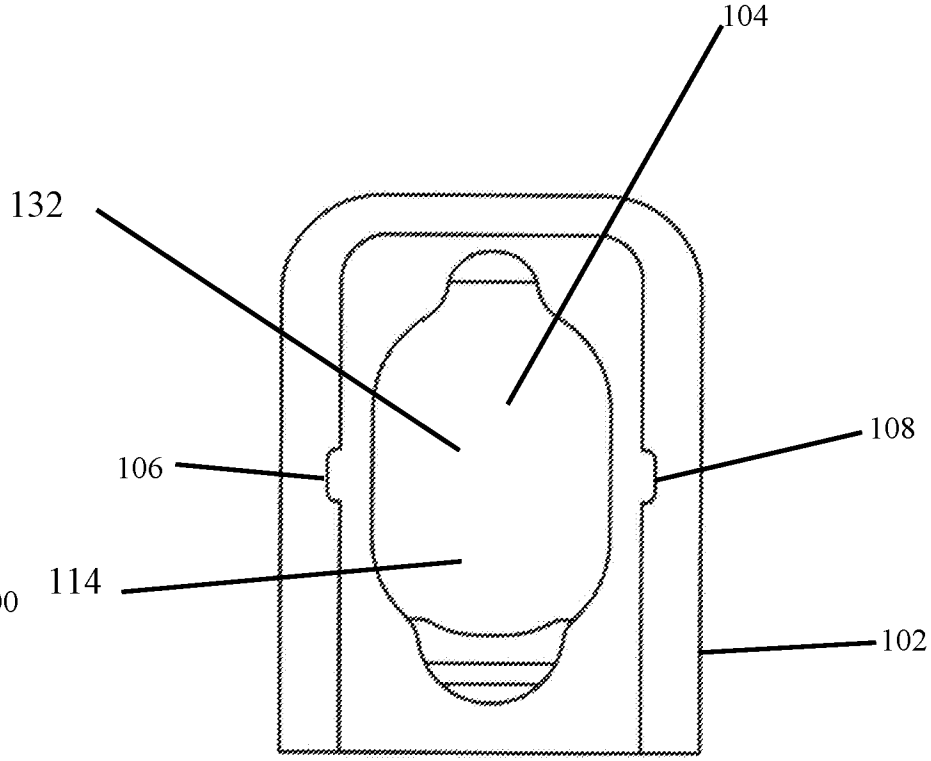
FIG. 6 is a top view thereof.

FIG. 6 shows tensioning aperture 104 through the base 102. The tensioning apertures provides access to the plate floor 132 of the plate 114. The spring contacts the plate floor 132 to provide the biasing force to the follower. The plate floor 132 loads the spring to bias the follower towards the chamber. Releasing the plate 114 drops the plate floor 132 to relieve tension on the follower.

Installation apertures 106, 108 provide an opening for installation of the base 102 onto the magazine. Such apertures 106, 108 provide vertical movement for installing the base 102 onto the magazine.

FIGS. 7 and 8 show the attachment and detachment of the attachment base 102 with the adjustment plate 114. FIG. 7 shows the adjustment plate 114 in the use position while FIG. 8 shows the adjustment plate 114 in the load position. Adjustment tracks 122, 124 provide a pathway for the attachment fingers 118, 120 to secure the adjustment plate 114 to the adjustment base 102. The adjustment tracks 122, 124 are located on opposite sides of the attachment base. In one embodiment, the adjustment tracks 122, 124 are located on the interior of the attachment base.

The track openings 121, 123 of the adjustment tracks 122, 124 allow insertion of the attachment fingers 118, 120 into the adjustment tracks 122, 124. The track openings 121, 123 of the adjustment tracks 122, 124 also allow removal of the attachment fingers 118, 120 from the adjustment tracks 122, 124. The track openings 121, 123 of the adjustment tracks 122, 124 provide sufficient movement of the adjustment plate 114 towards and away from the follower. In one embodiment, this movement is a vertical adjustment of the adjustment plate 114 towards and away from the follower.

Attachment fingers 118, 120 of plate 114 insert into adjustment tracks 122, 124 of the base 102 as shown in FIGS. 1 and 7. Attachment fingers 118, 120 secure the plate 114 in the use position. Plate 114 remains in position in relation to the housing 101. The attachment fingers 118, 120 inserted into the locking position 125 of the adjustment tracks 122, 124 limit movement of plate 114. The plate 114 places spring 94 in the proper position to load the chamber of the firearm when attachment fingers 118, 120 are secured within locking position 125 of the adjustment tracks 122, 124.

To load the magazine, the attachment fingers 118, 120 release from the locking position 125 of the adjustment tracks 122, 124 as shown in FIGS. 1 and 8. The plate 114 can then move away from the opening 103. Such movement of the plate 114 away from the follower reduces the force applied to the follower 92 by spring 94.

The adjustment tracks 122, 124 end at locking position 125. The locking position 125 limits movement of the adjustment plate 114 away from the follower and the opening in the housing and magazine. In one embodiment, locking position 125 limits vertical downward movement of the attachment fingers 122, 124.

In one embodiment, the adjustment tracks 122, 124 provide a stop 127. The stop 127 limits movement of the attachment fingers 118, 120 towards the opening of the adjustment tracks 122, 124. The stop 127 may limit lateral movement of the attachment fingers 118, 120. The locking position 125 of one embodiment is located laterally of the opening of the adjustment tracks 122, 124. The locking position 125 may be located vertically below the stop 127. Such a change in height secures the attachment fingers 118, 120 into the locking position 125. Placement of the attachment fingers 118, 120 into the locking position 125 secures the adjustment plate 114 into the use position.

Blocking foot 116 limits the extent to which adjustment plate 114 inserts into housing 101. Housing 101 provides a limited amount of space for the cartridges and follower 92 to move within the housing 101. Blocking foot 116 prevents adjustment plate 114 from inserting too far into base 102. The positioning of base 102 and adjustment plate 114 avoids interference with the follower 92 and the cartridges.

After loading the magazine 96, the user directs the plate 114 towards the follower. The attachment fingers 118, 120 insert into the locking position 125 of the adjustment tracks 122, 124 to secure the plate 114 in the use position for use of the magazine. The user then inserts the magazine 96 into the pistol for use. The magazine directs the cartridges into the chamber for use.

Figure 9:
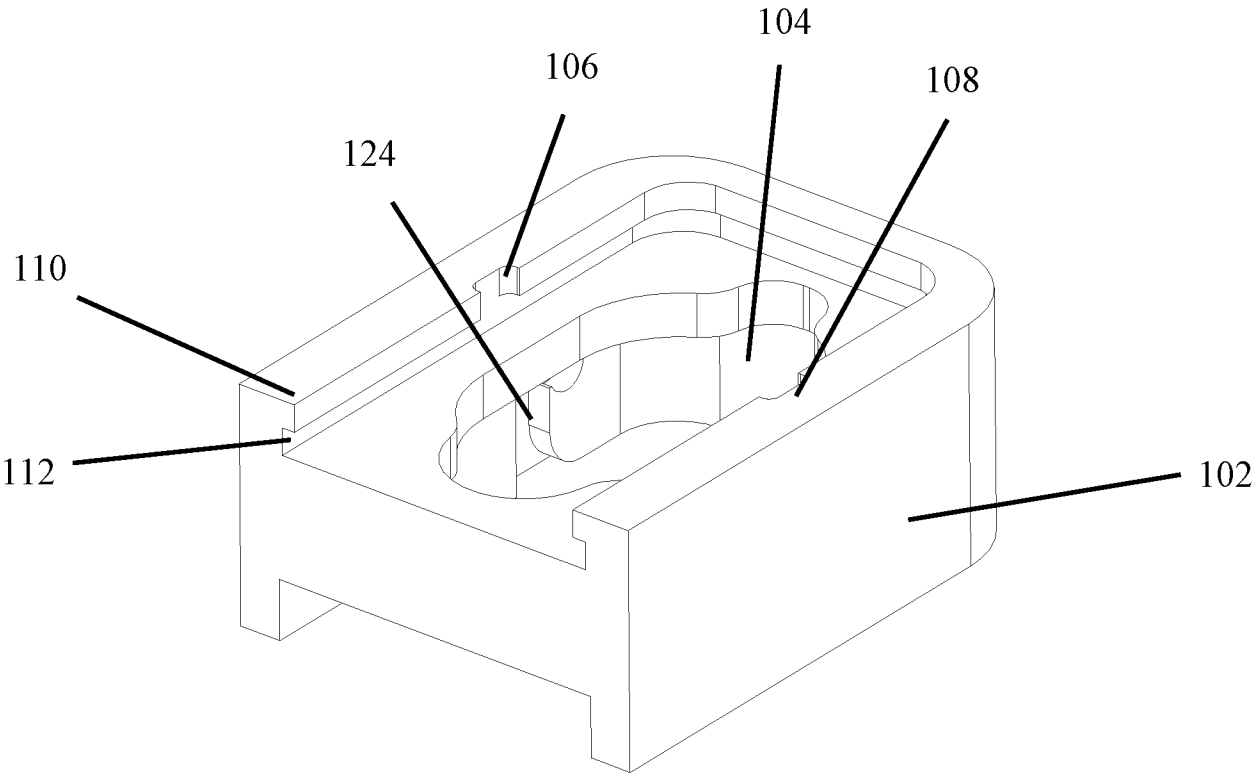
FIG. 9 is a perspective view of an attachment base of one embodiment of the present invention.
Figure 10:
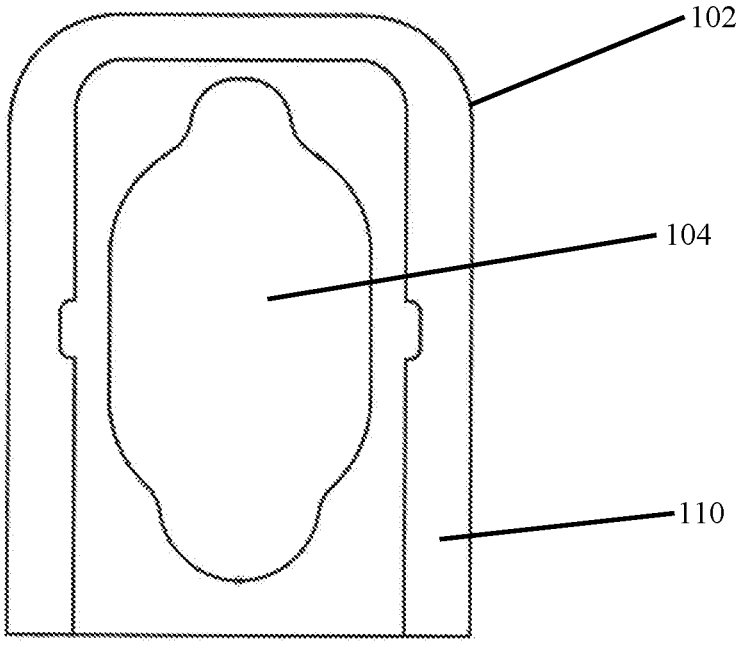
FIG. 10 is a top view thereof.
Figure 11:
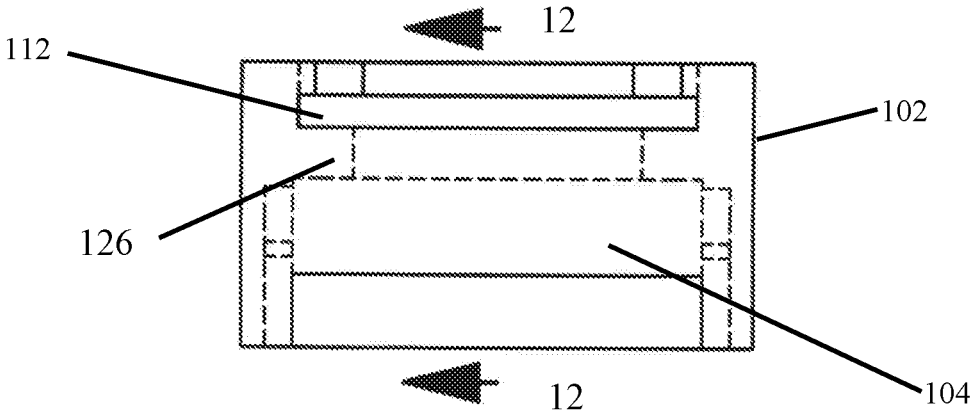
FIG. 11 is a sectional view thereof.

FIGS. 9-11 show the attachment base 102. The installation apertures 106, 108, 112 and attachment lip 110 secure the attachment base 102 to the magazine and housing. The tensioning aperture 104 allows passage of the biasing device, such as the spring, through the base 102. The biasing device, such as the spring, passes through the tensioning aperture 104 to contact the floor of the adjustment plate. The floor loads the spring against the follower.

Figure 12:
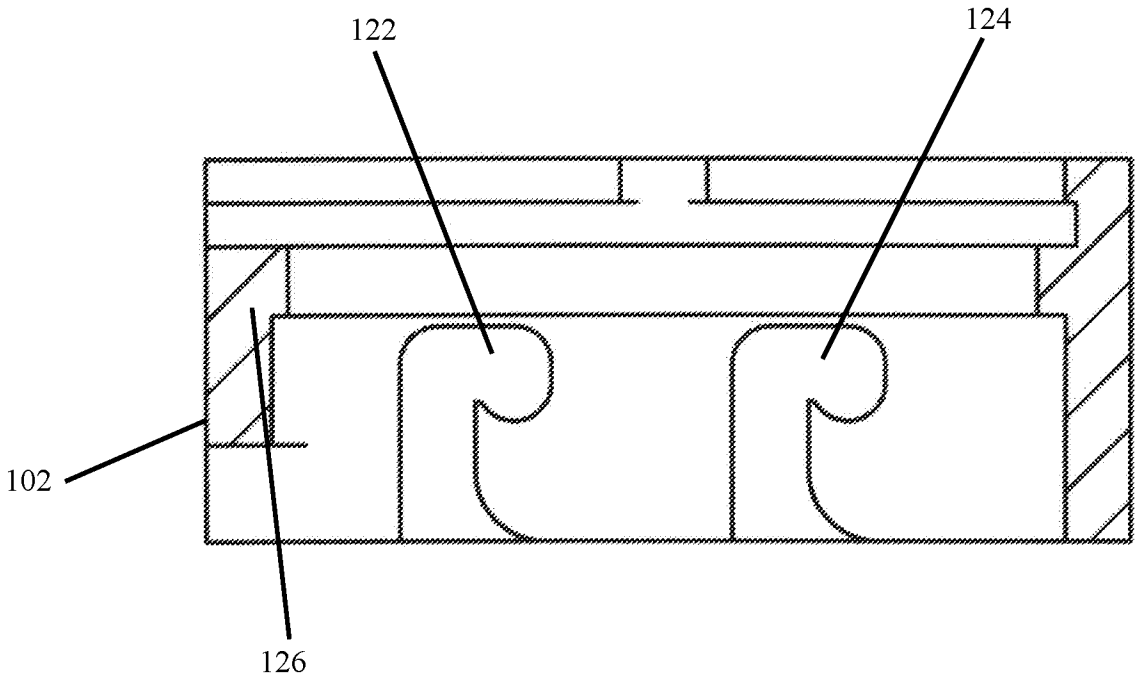
FIG. 12 is a sectional view thereof.

FIGS. 11-12 show the attachment neck 126 of the attachment base 102. The attachment neck 126 reduces the size of the tensioning aperture 104. The attachment neck 126 allows passage of the biasing device, such as the spring, through the base 102. The attachment neck 126 limits movement of the follower away from the opening in the magazine and the chamber. The attachment neck 126 also limits movement of the adjustment plate towards the follower, the opening in the magazine, and the chamber.

As shown in FIG. 12, the attachment neck 126 prevents the adjustment plate from travelling beyond the attachment neck 126. The adjustment tracks 122, 124 are located below the attachment neck 126 away from the opening in the magazine and the chamber.

FIGS. 13-16 show the adjustment plate 114. The blocking foot 116 limits movement of the adjustment plate 114 through the attachment base as indicated above.

Attachment fingers 118, 120, 128, 130 insert into adjustment tracks of the attachment base as indicated above. Attachment fingers 118, 120, 128, 130 protrude outward from the adjustment plate 114. The attachment fingers 118, 120, 128, 130 travel through the adjustment tracks located on the interior portion of the attachment base. The attachment fingers 118, 120, 128, 130 reach the locking position of the adjustment tracks to secure the adjustment plate 114 into the use position.

As indicated above, the adjustment plate 114 provides a plate floor 132 for contacting the spring. The spring contacts the plate floor 132 to provide the proper tension for biasing the follower.

Figure 13:
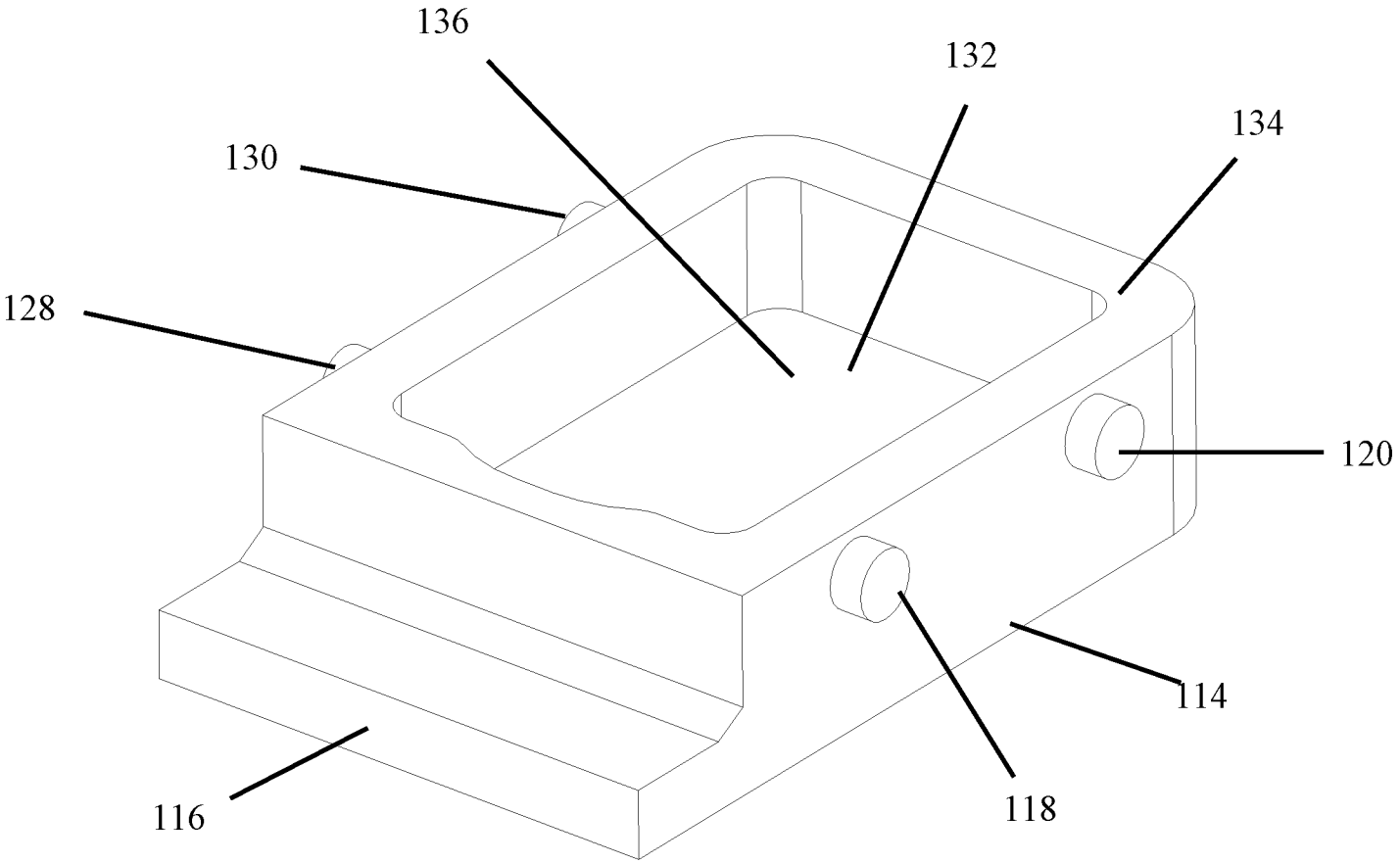
FIG. 13 is a perspective view of an adjustable plate of one embodiment of the present invention.
Figure 14:
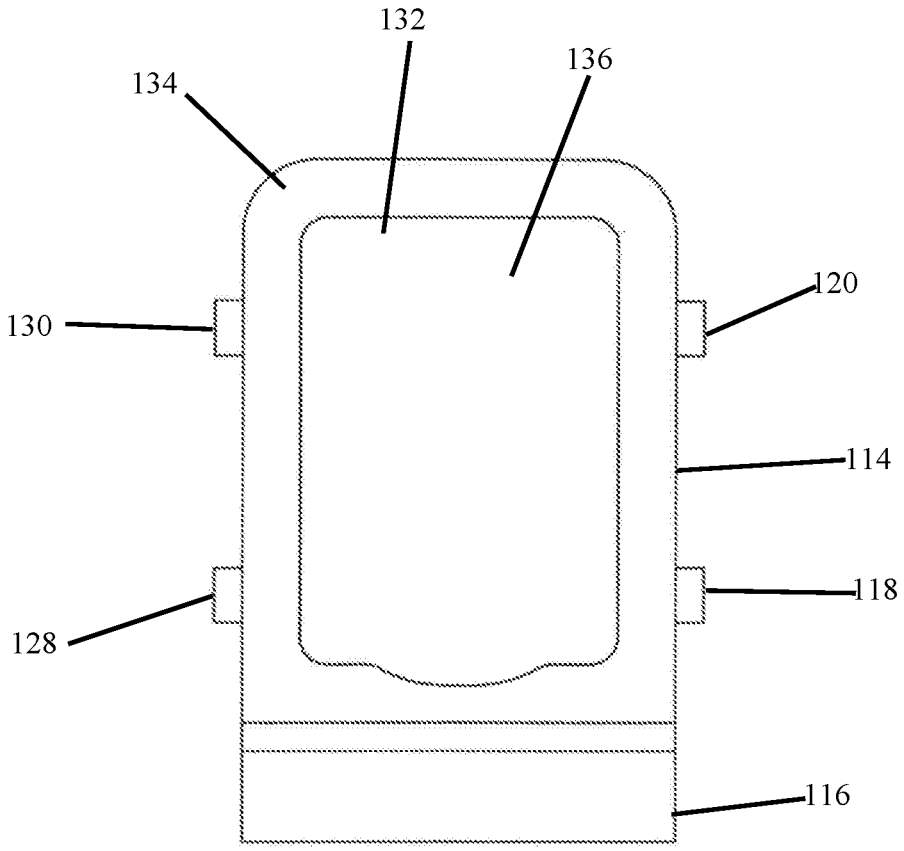
FIG. 14 is a top view thereof.
Figure 15:
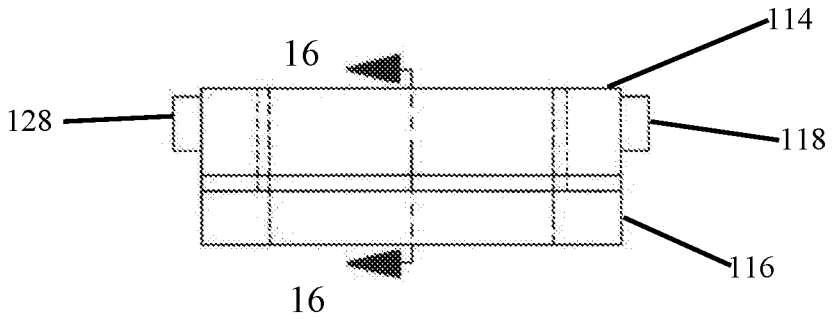
FIG. 15 is a front view thereof.
Figure 16:
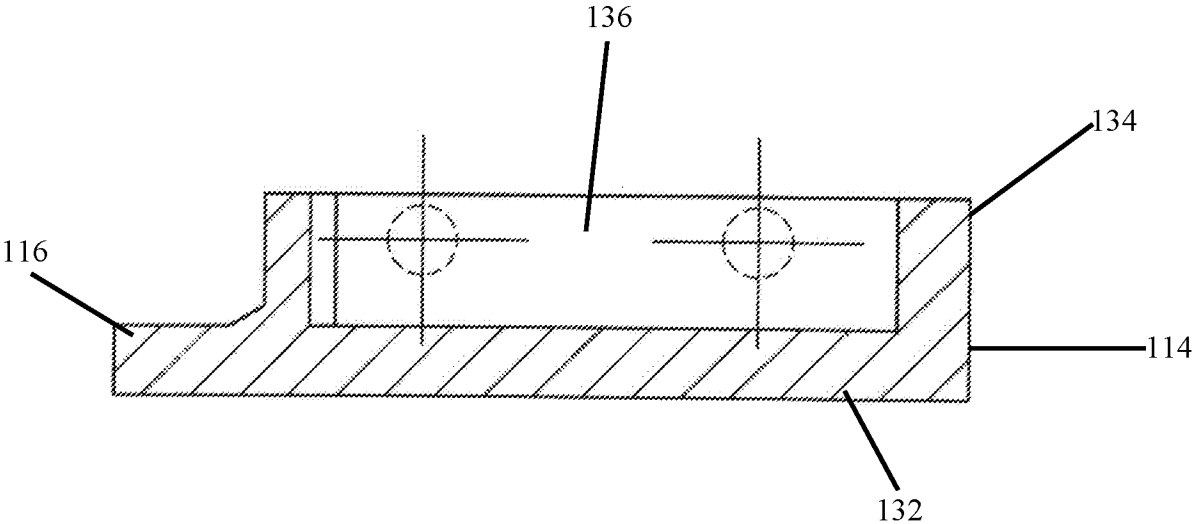
FIG. 16 is a sectional view thereof.

Referring to FIGS. 13, 14, and 16, the adjustment plate 114 provides a plate wall 132 to secure the spring onto the plate 114. The plate wall 132 protrudes from the plate floor 132 towards the follower, the opening of the magazine, and/or the chamber. The plate wall 132 of one embodiment extends above the plate floor 132.

The plate wall 132 defines a plate aperture 136 for placement of the spring. The plate wall 134 limits lateral movement of the spring. The plate wall 132 securing the spring onto the floor 132 loads the spring against the follower. Loading the spring places the magazine ready for use.

The present invention also provides a method of loading the magazine. To load the magazine, the user adjusts the adjustable plate into the load position. In one embodiment, the user moves the adjustable plate away from the opening in the magazine and/or the chamber.

Such adjustment may require the user to pass across a stop. The user presses the adjustable plate towards the opening in the magazine and/or chamber. The user then laterally adjusts the adjustment fingers across the stop. The user then moves the adjustment plate away from the chamber and/or the opening in the magazine.

The user may move the adjustment plate away from the opening in the magazine. The user may drop the adjustment plate a half inch to three inches, preferably an inch to reduce the pressure of the spring on the follower. In one embodiment, the pressure of the spring on the follower is reduced to almost no pressure.

The dropping of the adjustable plate reduces the spring pressure when loading the rounds. After loading the magazine, the user returns the adjustable plate to the use position. In the use position, the spring applies sufficient pressure on to the follower to chamber the rounds. The adjustable plate allows the use of the entire hand strength to reload the spring on the follower. The user reduces the pressure needed to load the magazine by adjusting the plate away from the follower, especially the last several rounds. The attachment fingers insert into the locking position. The magazine is ready for use within the firearm.

From the foregoing, it will be seen that the present invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A firearm magazine device that reduces tension of a spring on a follower within a magazine, the device comprising:

an adjustable plate that attaches to the magazine, the plate adjusting between a load position that reduces the tension of the spring on the follower and a use position that increases the tension of the spring on the follower; and a floor of the adjustable plate that provides a surface for placement of the spring to load the spring;

an adjustment track wherein the adjustable plate travels vertically upward along the adjustment track against the spring to tension the spring;

an attachment finger secured to the adjustable plate that fits within the adjustment track, wherein the attachment finger travels along the adjustment track;

an attachment base secured to the magazine, wherein the adjustment track is located on the attachment base;

a track opening of the adjustment track, wherein the track opening extends to a bottom edge of the attachment base to allow removal of the attachment finger from the adjustment track at the track opening; and a tether securing the plate to the magazine, wherein the tether attaches to the attachment base and the adjustable plate, the adjustable plate removable from an interior of the attachment base, wherein the tether secures the adjustable plate to the magazine after the adjustable plate is removed from the interior of the attachment base.

2. The device of claim 1 further comprising:

a tension aperture extending through the attachment base to the floor of the adjustable plate wherein the spring passes through the tension aperture to contact the floor.

3. The device of claim 2 further comprising:

wherein the adjustable plate adjusts along the adjustment track;

a locking position of the adjustment track wherein the locking position limits movement of the adjustable plate away from the follower.

4. The device of claim 3 wherein the locking position of the adjustment track limits movement of the attachment finger away from the follower.

5. The device of claim 3 further comprising:

the adjustment track located on an interior of the attachment base;

the attachment finger protruding outward from the adjustable plate wherein the attachment finger inserts into the adjustment track to reach a locking position in the adjustment track that limits movement of the plate away from the follower.

6. The device of claim 2 further comprising:

a blocking foot sized to contact the attachment base, the blocking foot limiting movement of the plate towards the follower.

7. The device of claim 1 further comprising:

an attachment neck that reduces the size of the tensioning aperture to limit movement of the follower and the adjustable plate.

8. The device of claim 1 further comprising:

a plate wall extending from the floor towards the follower wherein the plate wall limits movement of the spring.

9. A firearm magazine device that reduces tension of a spring on a follower within a magazine, the device comprising:

an adjustable plate that attaches to the magazine, the plate adjusting between a load position that reduces the tension of the spring on the follower and a use position that increases the tension of the spring on the follower; and a floor of the adjustable plate that provides a surface for placement of the spring to load the spring;

an adjustment track wherein the adjustable plate travels vertically upward along the adjustment track against the spring to tension the spring;

an attachment finger secured to the adjustable plate that fits within the adjustment track, wherein the attachment finger travels along the adjustment track;

an attachment base secured to the magazine, wherein the adjustment track is located on the attachment base;

a track opening of the adjustment track, wherein the track opening extends to a bottom edge of the attachment base to allow removal of the attachment finger from the adjustment track at the track opening; and a tether securing the plate to the attachment base, wherein the tether attaches to the attachment base and the adjustable plate, the adjustable plate removable from an interior of the attachment base, wherein the tether secures the adjustable plate to the attachment base after the adjustable plate is removed from the interior of the attachable plate, wherein the attachment finger travels through the track opening to remove the adjustable plate from the attachment base.

10. The device of claim 9 further comprising:

a tension aperture extending through the attachment base to the floor of the adjustable plate wherein the spring passes through the tension aperture to contact the floor.

11. The device of claim 10 further comprising:

wherein the adjustable plate adjusts along the adjustment track;

a locking position of the adjustment track wherein the locking position limits movement of the adjustable plate away from the follower.

12. The device of claim 11 wherein the locking position of the adjustment track limits movement of the attachment finger away from the follower.

13. The device of claim 11 further comprising:

the adjustment track located on an interior of the attachment base;

the attachment finger protruding outward from the adjustable plate wherein the attachment finger inserts into the adjustment track to reach a locking position in the adjustment track that limits movement of the plate away from the follower.

14. The device of claim 10 further comprising:

a blocking foot sized to contact the attachment base, the blocking foot limiting movement of the plate towards the follower.

15. The device of claim 9 further comprising:

an attachment neck that reduces the size of the tensioning aperture to limit movement of the follower and the adjustable plate.

16. The device of claim 9 further comprising:

a plate wall extending from the floor towards the follower wherein the plate wall limits movement of the spring.

17. A firearm magazine device that reduces tension of a spring on a follower within a magazine, the device comprising:

an adjustable plate that attaches to the magazine, the plate adjusting between a load position that reduces the tension of the spring on the follower and a use position that increases the tension of the spring on the follower; and a floor of the adjustable plate that provides a surface for placement of the spring to load the spring;

an adjustment track wherein the adjustable plate travels vertically upward along the adjustment track against the spring to tension the spring;

an attachment finger secured to the adjustable plate that fits within the adjustment track, wherein the attachment finger travels along the adjustment track;

an attachment base secured to the magazine, wherein the adjustment track is located on the attachment base;

a tether securing the plate to the magazine, wherein the tether attaches to the attachment base and the adjustable plate, the adjustable plate removable from an interior of the attachment base, wherein the tether secures the adjustable plate to the magazine after the adjustable plate is removed from the interior of the attachment base.

* * * * *